US011338966B2

(12) United States Patent
Dominguez

(10) Patent No.: US 11,338,966 B2
(45) Date of Patent: May 24, 2022

(54) DISPOSABLE CONTAINER

(71) Applicant: Juan Carlos Dominguez, Northridge, CA (US)

(72) Inventor: Juan Carlos Dominguez, Northridge, CA (US)

(73) Assignee: Juan Carlos Dominguez, Los Gatos, CA (US)

( * ) Notice: Subject to any disclaimer, the term of this patent is extended or adjusted under 35 U.S.C. 154(b) by 0 days.

(21) Appl. No.: 15/917,393

(22) Filed: Mar. 9, 2018

(65) Prior Publication Data

US 2019/0276197 A1 Sep. 12, 2019

(51) Int. Cl.

| | |
|---|---|
| ***B65D 43/26*** | (2006.01) |
| ***B65D 43/16*** | (2006.01) |
| ***B65F 1/16*** | (2006.01) |
| ***B65F 1/00*** | (2006.01) |
| ***B65D 21/08*** | (2006.01) |
| ***B65D 77/06*** | (2006.01) |

(52) U.S. Cl.

CPC ..... *B65D 43/262* (2013.01); *B65D 21/086* (2013.01); *B65D 77/06* (2013.01); *B65F 1/0006* (2013.01)

(58) Field of Classification Search

CPC .. B65D 43/262; B65D 43/168; B65D 21/086; B65D 77/06; B65D 7/26; B65F 1/0006; B65F 1/163; B65F 2220/106; B65F 2220/1063

USPC ..... 220/263, 262, 264, 666, 6

See application file for complete search history.

(56) References Cited

U.S. PATENT DOCUMENTS

| | | | | | |
|---|---|---|---|---|---|
| 1,966,323 | A * | 7/1934 | Von Elm | B65F 1/08 | 220/263 |
| 2,527,449 | A * | 10/1950 | Poole | B65B 67/1211 | 220/264 |
| 2,549,572 | A * | 4/1951 | Campanelli | B65F 1/14 | 220/212 |
| 2,764,776 | A * | 10/1956 | Peguero | A47L 13/502 | 15/310 |
| 4,164,178 | A * | 8/1979 | Baumann | B65F 1/163 | 100/99 |
| 5,082,132 | A * | 1/1992 | Tsai | B65F 1/0066 | 220/23.83 |
| 6,039,200 | A * | 3/2000 | Armor | B65F 1/163 | 220/263 |
| 7,364,049 | B2 * | 4/2008 | Panek, Jr. | B65F 1/1468 | 220/345.1 |
| 8,308,009 | B2 * | 11/2012 | Joordens | B65F 1/1623 | 220/264 |

(Continued)

*Primary Examiner* — Andrew D Perreault

(74) *Attorney, Agent, or Firm* — Fish & Richardson P.C.

(57) ABSTRACT

A disposable container is disclosed that includes a lid, a frontward facing sidewall portion, a rearward facing sidewall portion that is opposite the frontward facing sidewall portion, a first foldable sidewall portion, a second foldable sidewall portion that is opposite the first foldable sidewall portion, a pedal, wherein the pedal is rotatably coupled to the frontward facing portion, a hinge mechanism, wherein the hinge mechanism is rotatably coupled to the lid and the rearward facing sidewall portion, and two or more lines that each have a first line end and a second line end, wherein the first line end of each of the two or more lines is coupled to the pedal and the second line end of each of the two or more lines is coupled to the hinge mechanism.

11 Claims, 8 Drawing Sheets

(56) References Cited

U.S. PATENT DOCUMENTS

| | | | | |
|---|---|---|---|---|
| 2004/0004080 | A1* | 1/2004 | Yang | B65F 1/163<br>220/263 |
| 2007/0182551 | A1* | 8/2007 | Yang | B65F 1/08<br>340/545.3 |
| 2008/0128422 | A1* | 6/2008 | Adler | B60R 7/043<br>220/495.06 |
| 2019/0098871 | A1* | 4/2019 | Miedel | A01K 15/021 |

* cited by examiner

DISPOSABLE CONTAINER

BACKGROUND

Waste disposal containers serve an important utility of providing a person with a place where waste may be discarded. Waste may include anything that a person wants to discard. Such containers are conventionally lined with a plastic bag so that, when the container becomes full, a person can empty the container by removing the bag. Though the plastic bag is removed, the container remains.

A typical person is conditioned to believe that removing the plastic bag leaves the waste container clean. However, the waste discarded into a container can include items that are contaminated with health hazards such as viruses, bacteria, and other contaminates that pose health risks. A person can come into contact with these health hazards when changing a waste bag. Moreover, some of these hazards remain for at least a period of time after the bag has been removed.

SUMMARY

The present disclosure provides a disposable container that can be used to contain one or more items. For example, the disposable container can be used as a disposable trash can. Alternatively, the disposable container be used as a storage bin for items that are not trash or waste. Alternatively, the disposable container may be used as a beverage dispenser to dispense bagged liquids such as bagged water, bagged juice, bagged wine, or the like.

According to at least one aspect of the present disclosure, a disposable container is disclosed for containing items. The disposable container may include a lid, a frontward facing sidewall portion, a rearward facing sidewall portion that is opposite the frontward facing sidewall portion, a first foldable sidewall portion, a second foldable sidewall portion that is opposite the first foldable sidewall portion, and a pedal. The pedal is rotatably coupled to the frontward facing portion. The container may include a hinge mechanism, wherein the hinge mechanism is rotatably coupled to the lid and the rearward facing sidewall portion. The container may also contain two or more lines that each have a first line end and a second line end, wherein the first line end of each of the two or more lines is coupled to the pedal and the second line end of each of the two or more lines is coupled to the hinge mechanism.

This version, and other versions, may optionally include one or more of the following features. For example, in some implementations, the at least a portion of the pedal is configured to (i) rotate downwards in response to the application of a first force to the pedal and (ii) apply a second force to at least one of the two or more lines in response to the first force that is applied to the pedal.

In some implementations, the at least a portion of the hinge mechanism is configured to rotate downwards and apply a third force to the lid in response to the second force that is applied to at least one of the two or more lines by the pedal responsive to the first applied force.

In some implementations, the lid is configured to open in response to the third force that is applied to the lid responsive to the downwards rotation of at least a portion of the hinge mechanism.

In some implementations, the frontward facing sidewall portion comprises multiple openings that may include a first opening and a second opening that are each configured to receive a line of the two or more lines and the rearward facing sidewall portion comprises multiple openings that may include a third opening and a fourth opening that are each configured to receive a line of the two or more lines.

In some implementations, the first line of the two or more lines extends from the first end that is coupled to the pedal through the first opening and through the third opening to the second end that is coupled to the hinge mechanism and the second line of the two or more lines extends from the pedal through the first end that is coupled to the pedal through the second opening and through the fourth opening to the second end that is coupled to the hinge mechanism.

In some implementations, applying a first force to the pedal pulls (i) a first line of the two or more lines through the first opening and the third opening and exerts a second force on the hinge mechanism and (ii) a second line of the two or more lines through the second opening and the fourth opening and exerts a third force on the hinge mechanism.

In some implementations, the hinge mechanism exerts one or more fourth forces to the lid in response to the second force and the third force.

In some implementations, the lid is configured to separate from at least a portion of the frontward facing sidewall portion, the first foldable sidewall portion, and the second foldable sidewall portion in response to the one or more fourth forces.

In some implementations, terminating application of the first force from the pedal retracts (i) at least a portion of the first line of the two or more lines through the third opening and the first opening and (ii) at least a portion of the second line of the two or more lines through the fourth opening and the second opening.

In some implementations, the lid is configured to move back towards one or more of the frontward facing sidewall portion, the first foldable sidewall portion, or the second foldable sidewall portion in response to termination of the application of the first force.

In some implementations, the lid that may include a rotating panel that can be configured into different states that comprise a closed state and an open state, wherein the closed state denies access to an interior of the disposable container through the lid and the open state provides access to the interior of the disposable container through the lid.

In some implementations, the disposable container may further include two or more flexible members that are configured to initiate expansion of the disposable container form a collapsed state to an expanded state.

In some implementations, the two or more flexible members may include a first flexible member and a second flexible member, the first flexible member may include a first end and a second end that each terminate at the first foldable sidewall portion, and the second flexible member may include a second end and a third end that each terminate at the second foldable sidewall portion.

In some implementations, the disposable container may further include a hanging mechanism that includes (i) a first portion that is coupled to the rearward facing sidewall portion and (ii) a second portion that is configured to securely engage at least a portion of a second object.

In some implementations, the second portion that is configured to securely engage at least a portion of the second object may include a double-sided tape, wherein the double-sided tape includes a first tape-side that includes adhesive that secures the tape to the rearward facing sidewall portion and a second tap-side that includes adhesive that is configured to adhere to the portion of the second object.

In some implementations, the disposable container may further include a plurality of collapsible legs, wherein each collapsible leg of the plurality of collapsible legs is configured to rotatably extend from a bottom of the disposable container.

In some implementations, the plurality of collapsible legs may include a first collapsible leg that rotatably extends away from the bottom of the disposable container towards the first foldable sidewall portion and a second collapsible leg that rotatably extends away from the bottom of the disposable container towards a second foldable sidewall portion.

In some implementations, the rearward facing sidewall portion includes a rotatable access panel, wherein at least a portion of the rotatable access panel provides access to the interior portion of the disposable container.

In some implementations, least the frontward facing sidewall portion, the rearward facing sidewall portion, the first foldable sidewall portion, the second foldable sidewall portion, and the lid are made of cardboard.

DETAILED DESCRIPTION

Figure 1:
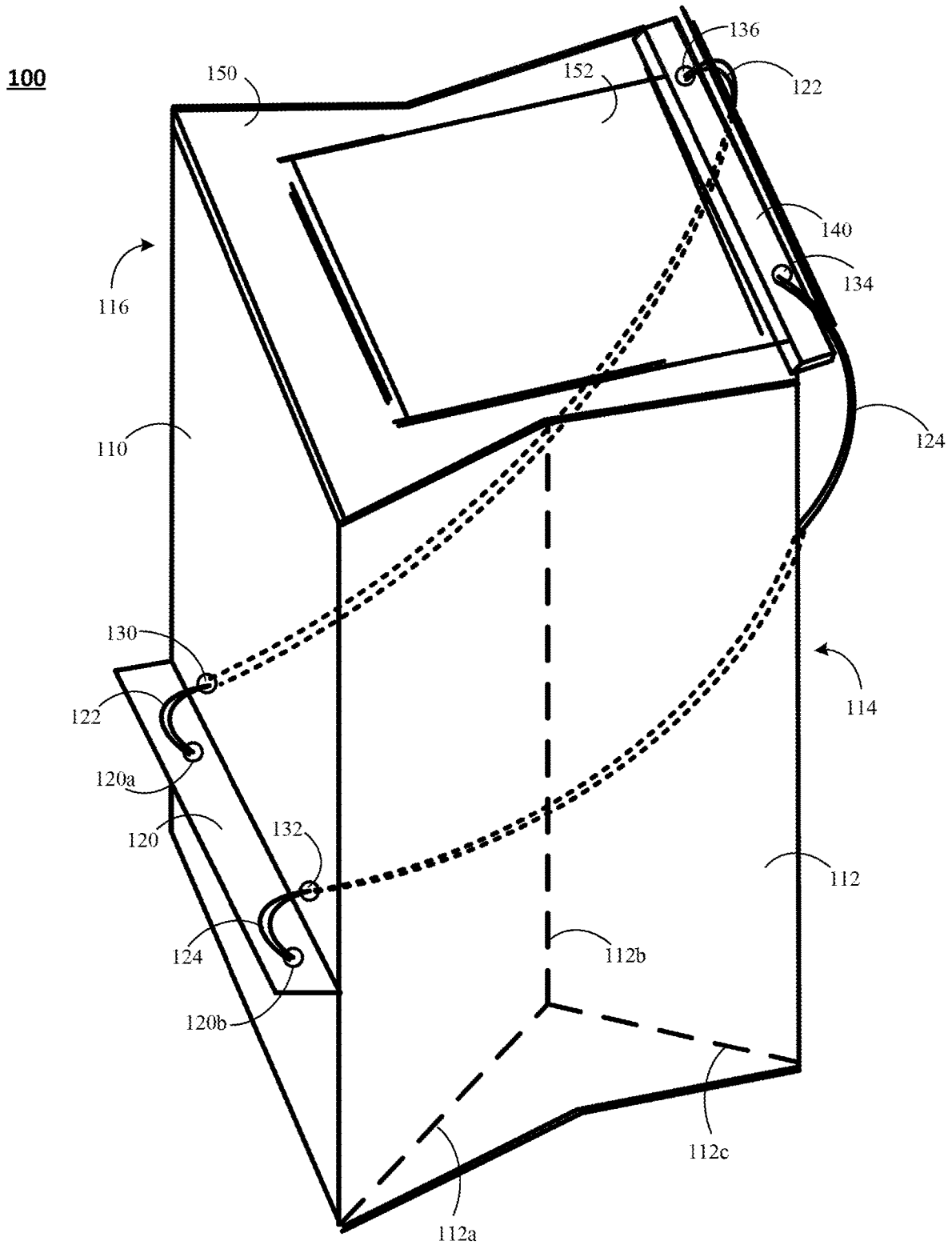
FIG. 1 is a forward perspective view of an example of a disposable container.

FIG. 1 is a first forward perspective view of an example of a disposable container 100. The disposable container 100 includes a frontward facing sidewall portion 110, a first foldable sidewall portion 112, a rearward facing sidewall portion 114, a second foldable sidewall portion 116, a pedal 120, a plurality of lines 122, 124, a hinge mechanism 140, and a lid 150.

The disposable container 100 includes lines 122, 124 that each include a first end and a second end. Line 122 is coupled to the pedal 120 at a line coupling point 120*a*. Line 122 may be coupled to the coupling point 120*a* of the pedal 120 in a variety of different ways. For example, line 122 may be fed through a coupling point 120*a* in the pedal 120 and tied in a knot that prevents the first end of line 122 from being pulled through the coupling point 120*a* in the pedal 120. Alternatively, or in addition, the first end of line 122 may be glued, stapled, or the like to the coupling point 120*a* of the pedal 120. The coupling point 120*a* may include an opening (e.g., a hole) or a location on the pedal 120 that the first end of line 122 is coupled to that is not an opening. For example, the first end of line 122 may be stapled or glued to a location of the pedal 120 that is identified as coupling point 120*a* without the need for the coupling point 120*a* to include an opening through the pedal 120.

Figure 3:
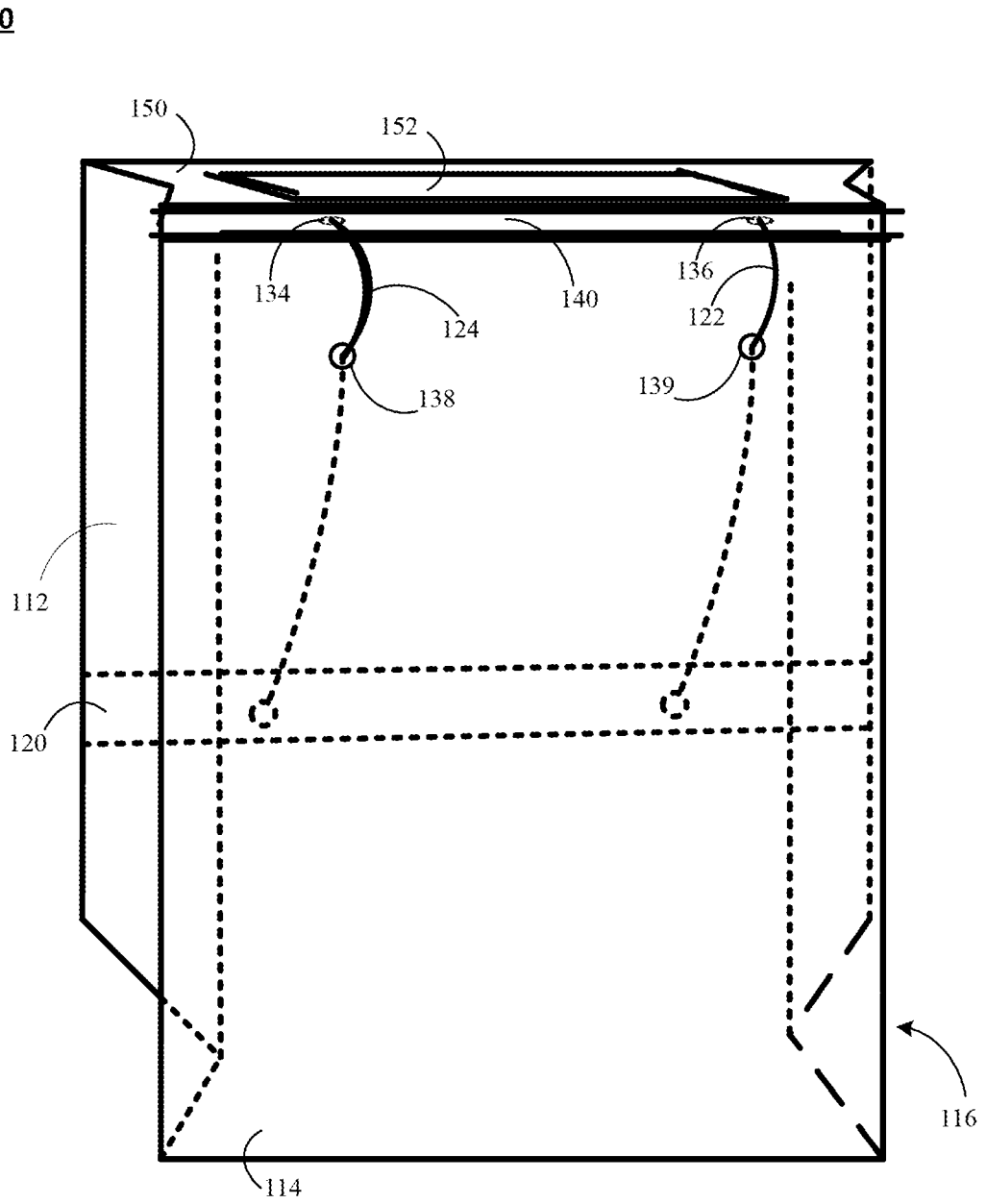
FIG. 3 is a rearward perspective view of an example of the disposable container of FIG. 1.

In some implementations, such as the implementation depicted in FIG. 1, line 122 may extend from the pedal 120 through a first opening 130 in the frontward facing sidewall portion and run through the interior of the disposable container 100 and through an third opening 139 in the rearward facing sidewall portion 114 (as shown, e.g., in FIG. 3). The second end of line 122 terminates at the hinged mechanism 140 and couples to the hinged mechanism at 136. The second end of line 122 may be coupled to the hinged mechanism 140 in a variety of different ways. For example, line 122 may be fed through a coupling point 136 in the hinged mechanism 140 and tied in a knot that prevents the second end of line 122 from being pulled through the coupling point 136 in the hinged mechanism 140. Alternatively, or in addition, the second end of line 122 may be glued, stapled, or the like to the connection point 136 of the hinged mechanism 130.

A line such as line 122 or line 124 may include a length of any type of material that can be used to connect the pedal 120 to the hinged mechanism 140. Such a line may include, for example, a length of cord, a length of rope, a length of wire, a length of chain links, a length of yarn, a length of ribbon, or the like.

Line 124 is coupled to the pedal 120. Line 124 may be coupled to the pedal 120 in a variety of different ways. For example, line 124 may be fed through a coupling point 120*b* in the pedal 120 and tied in a knot that prevents the first end of line 124 from being pulled through the coupling point 120*b* in the pedal 120. Alternatively, or in addition, the first end of line 124 may be glued, stapled, or the like to the coupling point 120*b* of the pedal 120. The coupling point 120*b* may include an opening (e.g., a hole) or a location on the pedal 120 that the first end of line 124 is coupled to that is not an opening. For example, the first end of line 124 may be stapled or glued to a location of the pedal 120 that is identified as coupling point 120*b* without the need for the coupling point 120*b* to include an opening through the pedal 120.

In some implementations, such as the implementation depicted in FIG. 1, line 124 may extend from the pedal 120 through a second opening 132 in the frontward facing sidewall portion and run through the interior of the disposable container 100 and through a fourth opening 138 in the rearward facing sidewall portion 114 (as shown, e.g., in FIG. 3). The second end of line 124 terminates at the hinged mechanism 140 and couples to the hinged mechanism 140 at 134. The second end of line 124 may be coupled to the hinged mechanism 140 in a variety of different ways. For example, line 124 may be fed through a coupling point 134 in the hinged mechanism 140 and tied in a knot that prevents the second end of line 124 from being pulled through the coupling point 134 in the hinged mechanism 140. Alternatively, or in addition, the second end of line 124 may be glued, stapled, or the like to the connection point 134 of the hinged mechanism 140.

The example of FIG. 1 describes a disposable container 100 that includes lines 122, 124 that extend from the pedal 120 to the hinge mechanism 140 and through the interior of the disposable container 100. However, the present disclosure need not be so limited. For example, in some implementations, one or more of lines 122, 124 may extend from the pedal 120 to the hinge mechanism 140 without passing through the interior of the disposable container 100. In such implementations, one or more of the lines 122, 124 may reside on the exterior of the disposable container 100, thereby extending from the pedal 130 to the hinge mechanism 140 along the exterior of the disposable container 100.

The disposable container 100 includes a lid 150. The lid 150 may be coupled to the hinge mechanism 140. The coupling of the lid 150 to the hinge mechanism 150 may be direct or indirect. Direct coupling may include at least a portion of the lid 150 directly contacting at least a portion of the hinge mechanism 140. For example, the lid 150 may be directly coupled to the hinge mechanism 140 using an adhesive. Alternatively, in some implementations, the lid 150 may be indirectly coupled to the hinge mechanism 140. In such implementations, the lid 150 may be adhere to an intervening portion that is also adhered to the hinge mechanism 150. The lid 150 may be opened responsive to a force applied to the pedal 120, which then applies a force to the lines 122, 124, and then the lines 122, 124 apply a force to the hinge mechanism 140 causing at least a portion of the hinge mechanism 140 to rotate downwards. The downwards rotation of the hinge mechanism 140 exerts a force on the lid 150 that opens the lid. The lid 150 may be closed responsive to the termination of the force applied to the pedal 120. The lid 150 may include a rotatable access panel 152 that can be manually configured into an open state or a closed state. In some implementations, the rotatable access panel 152 may be configured to rotate anywhere from 0 to 90 degrees from the closed stat to the open state around an axis at the end of the rotatable access panel 152 that is proximate the rearward facing side wall portion 114. In other implementations, the rotatable access panel 152 may be configured to rotate from 0 to 360 degrees around a central axis.

The rotatable access panel 152 may be configured to removably engage the inner edges of the lid 150. Removably engaging the inner edges of the lid 150 allows the rotatable access panel 152 to engage the inner edges of the lid 150 so that the rotatable access panel 152 can maintain its current open or close state when the lid 150 is opened or closed without altering the current state (e.g., open or closed) of the rotatable access panel 152. In addition, removably engaging enables the rotatable access panel 152 to be adjusted to a different open or closed state in response to a manual force applied by a person that exceeds a threshold amount of force sufficient to disengage the rotatable access panel 152 from the inner edges of the lid 150.

The disposable container 100 is foldable. For example, the disposable container 100 is expandable and collapsible. The disposable container 100 is enabled to expand and collapse based on the flexible nature of the first foldable sidewall portion 112 and the second foldable sidewall portion 116 (shown in, e.g., FIG. 2). For example, the first foldable sidewall portion 112 is configured to flex along predefined creases 112*a*, 112*b*, 112*c* and the second foldable sidewall portion 116 is configured to flex along predefined creases 116*a*, 116*b*, 116*c* shown in FIG. 2. The placement and number of predefined creases 112*a*, 112*b*, 112*c*, 116*a*, 116*b*, 116*c* is merely exemplary. Any number of predefined creases, and they respective placements may be used in order to facilitate expansion and collapse of the disposable container 100. For example, in some implementations, the rearward facing sidewall portion 110, the rearward facing sidewall portion 114, or both, may have one or more predefined creases in order to facilitate the flexibility of the disposable container 100.

In some implementations, the expansion of the disposable container 100 from a collapsed state to an expanded state may be performed manually by a person folding and unfolding the disposable container 100 along the one or more predefined creases. In other implementations, the disposable container 100 may be configured to automatically occur using one or more flexible members that are installed on the interior walls of the first foldable sidewall portion 112 and the second foldable sidewall portion 116. For example, the one or more flexible members shown in FIGS. 7A-7C may be configured to flex in response to the application of a force and then expand in response to the relief of the force, thereby causing the foldable sidewalls 112, 116 of the disposable container 100 to expand in response to the force caused by the expansion of the flexible members.

In some implementations, the disposable container 100 may also include a hanging mechanism. The hanging mechanism may be configured to hang the disposable container 100 from a hanging unit or other surface. The hanging mechanism may include a first portion and a second portion. In some implementations, the first portion of the hanging unit may be coupled to the rearward facing sidewall portion 114 and a second portion of the hanging unit may be configured to securely engage at least a portion of a second object such as a hanging unit or other surface.

The second portion of the hanging mechanism that is configured to securely engage at least a portion of the second object may include a variety of different coupling units. For example, the coupling unit of the second portion of the hanging mechanism may include double-sided tape or other adhesive. In implementations using double-sided tape, the double-sided tape may include a first tape-side that includes adhesive that secures the tape to the rearward facing sidewall portion 114 and a second tape-side that includes adhesive that is configured to adhere to the portion of the second object from which the disposable container 100 will hang.

Figure 2:
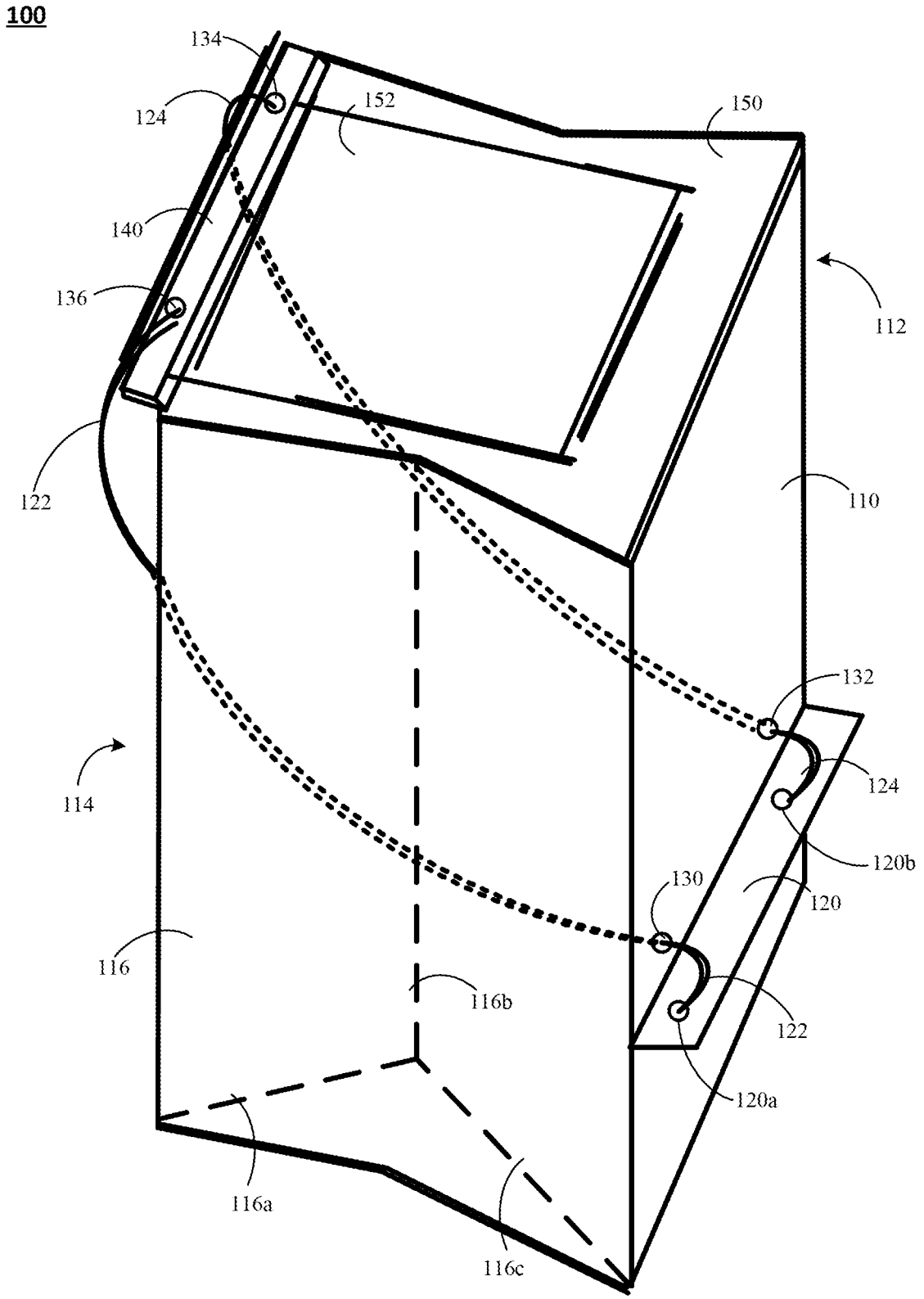
FIG. 2 is a forward perspective view of an example of the disposable container of FIG. 1.

FIG. 2 is a second forward perspective view of an example of a disposable container 100. The disposable container 100 shown in FIG. 2 is the same as the disposable container 100 shown in FIG. 1. However disposable container 100 of FIG. 2 is shown from a different point of view. For example, the disposable container of FIG. 2 is oriented to show the second foldable side-wall portion 116 and the one or more predefined creases 116*a*, 116*b*, 116*c*.

The second foldable sidewall portion 116 is configured to flex along predefined creases 116*a*, 116*b*, 116*c* in the same manner as described with reference to the predefined creases of FIG. 1. Any number of predefined creases, and they respective placements may be used in order to facilitate expansion and collapse of the disposable container 100. For example, in some implementations, the rearward facing sidewall portion 110, the rearward facing sidewall portion 114, or both, may have one or more predefined creases in order to facilitate the flexibility of the disposable container 100.

FIG. 3 is a rearward perspective view of an example of a disposable container 100. The disposable container 100 shown in FIG. 3 is the same as the disposable container 100 shown in FIGS. 1 and 2. However, the disposable container 100 of FIG. 3 is shown from a different point of view than the disposable container 100 shown in FIGS. 1 and 2.

The rearward perspective view of the disposable container 100 shows the rearward facing sidewall portion 114. The rearward facing sidewall portion 114 may include a plurality of openings that include the third opening 139 and the fourth opening 138. In some implementations, the third opening 139 and the fourth opening 138 can be used to enable the lines 122 and 124 to pass through from the interior of the disposable container 100 to the exterior of the disposable container 100. In such implementations, the lines 122, 124, after passing through the third opening 139 and the fourth opening 138, respectively, can terminate at the hinged mechanism 140. The line 122 is coupled to the coupling unit 136 and the line 124 is coupled to the coupling unit 134.

Figure 4:
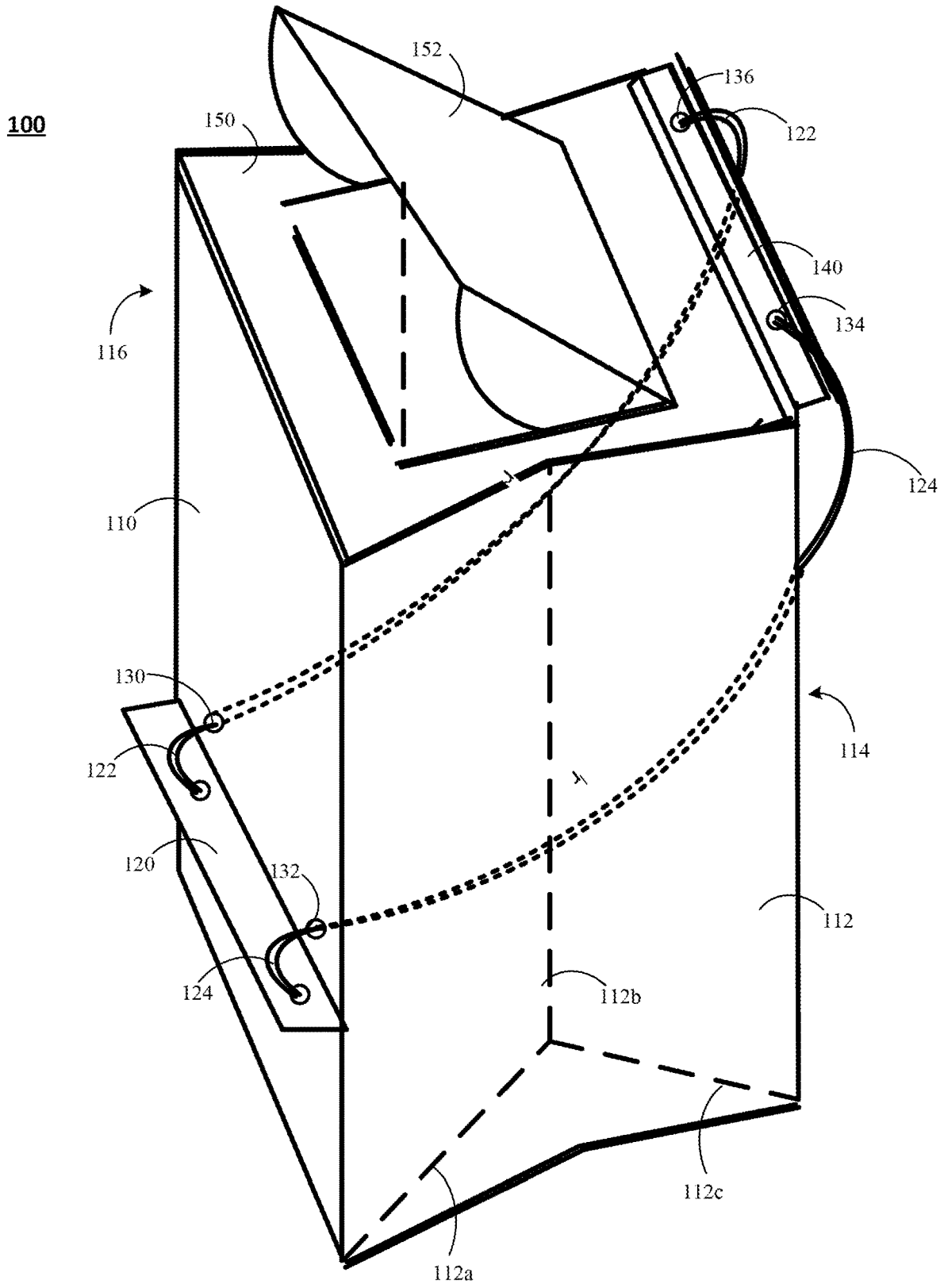
FIG. 4 is a forward perspective view of an example of the disposable container of FIG. 1 with an open rotating panel.

FIG. 4 is a forward perspective view of an example of a disposable container 100 with an open rotatable access panel 152. The disposable container 100 shown in FIG. 4 is the same as the disposable container 100 shown in FIGS. 1-3. However, the disposable container 100 shown in FIG. 4 is shown with the rotatable access panel that has been manually opened.

The rotatable access panel 152 can be manually configured into an open state or a closed state. When the rotatable access panel 152 is configured into the open state, as shown in FIG. 4, the rotatable access panel 152 provides the advantage of easy access to the inside of the disposable container 100. A person may take advantage of this easy access to the interior of the disposable container 100 to dispose of small items quickly and easily without using the pedal 120 to open the lid 150. In some instances, once the rotatable access panel 152 is configured into the open state, a person may be able to dispose of one or more items through the opening from a distance that separates the person and the disposable container when the person cannot reach the pedal 120. For example, a user could throw an item from a distance and into the opening created by the rotatable lid 152. In other instances, the person may choose to dispose of an item through the opening created in the top of the disposable container 100 when the rotatable access panel 152 is configured in the open state without opening the lid 150 because it is faster than using the pedal to open the lid 150.

In some implementations, the rotatable access panel 152 may be configured to rotate anywhere from 0 to 90 degrees from a closed state to an open state around an axis at the end of the rotatable access panel 152 that is proximate the rearward facing side wall portion 114. In other implementations, the rotatable access panel 152 may be configured to rotate from 0 to 360 degrees around a central axis that runs through the middle of the rotatable access panel 152. The rotatable access panel 152 can maintain a particular state by removably engaging the interior edges of the lid 150. Removably engaging the inner edges of the lid 150 allows the rotatable access panel 152 to stabilize itself using the inner edges of the lid 152 in order to maintain its current opened or closed state when the lid 150 is opened or closed.

Figure 5:
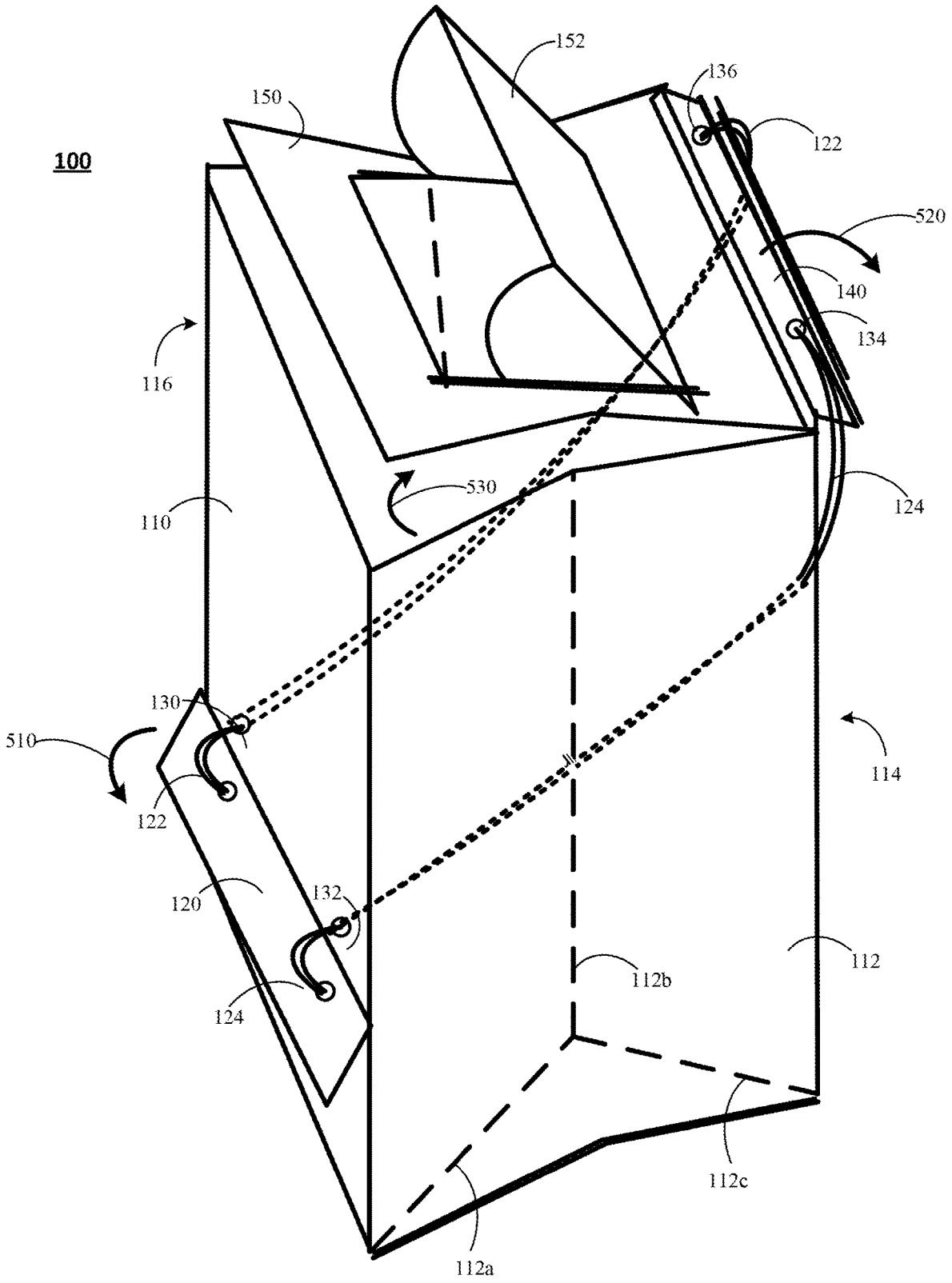
FIG. 5 is a forward perspective view of an example of the disposable container of FIG. 1 with an open rotatable access panel and an open lid.

FIG. 5 is a forward perspective view of an example of a disposable container 100 with an open rotatable access panel 152 and an open lid 150. The disposable container 100 shown in FIG. 5 is the same as the disposable container 100 shown in FIGS. 1-4. However, the disposable container 100 shown in FIG. 5 is shown with an open lid 150 and a rotatable access panel 152 that is in an open state and removably coupled to the interior edges of the lid 150.

With reference to FIG. 5, the figure uses arrows 510, 520, 530 to indicate movement related to opening the lid 150 in response to the application of a first to the pedal 120. One typical use case may include a person applying a first force to a portion of the pedal 120. Responsive to the first force caused, for example, by a person pressing the pedal 120, at least a portion of the pedal 120 may rotate 510 downwards away from lid 150 and towards the bottom of the disposable container 100. The rotation 510 of the pedal 120 triggers a second force and a third force to the line 122 and the line 124, respectively. The second force pulls the line 122 through the opening 130 and the third force pulls the line 124 through the opening 132. The movement of the lines 122 and 124 applies a fourth force (from the pull of the line 122) and a fifth force (from the pull of the line 124) to the hinged mechanism 140.

The application of the fourth force and the fifth force to the hinged mechanism 140 causes at least a portion of the hinged mechanism to rotate 520 downwards towards the bottom of the disposable container 100 and away from the lid 150. The rotation of the hinged mechanism 140 applies a sixth force to the lid 150 and causes the lid 150 to rotate 530 open. The opening created from the rotation 530 is directly proportional to the force applied to the pedal 120.

The lid 150 is configured to remain open so long as the pedal 120 is pressed down by a person. Once the pedal 120 is depressed, and the application of the first force is gradually withdrawn, the lid 150 may begin to close at a rate that is proportional to the withdrawal of the first force from the pedal 120. Withdrawal of the first force causes at least a portion of the pedal 120 to rotate upwards away from the bottom of the disposable container 100 and towards the lid of the disposable container 100. Withdrawal of the first force and rotation upwards of the pedal 120 gradually reduces the second force on the line 122 and the third force on the line 124. The gradual reduction of the second force on the line 122 and the third force on the line 124 gradually reduces the fourth force and the fifth force on the hinged mechanism 140. Reduction of fifth force and the sixth force on the hinged mechanism 140 causes at least a portion of the hinged mechanism to gradually rotate upwards away from the bottom of the disposable container 100 and towards the lid 150. This gradual upwards rotation of the hinged mechanism 140 gradually reduces the sixth force on the lid 150 and allows the lid 150 to gradually rotate back towards the closed position where the lid 150 may contact one or more upper edges of the forward facing sidewall portion 110, the first foldable sidewall portion 112, the rearward facing sidewall portion 114, and the second foldable sidewall portion 116.

Figure 6:
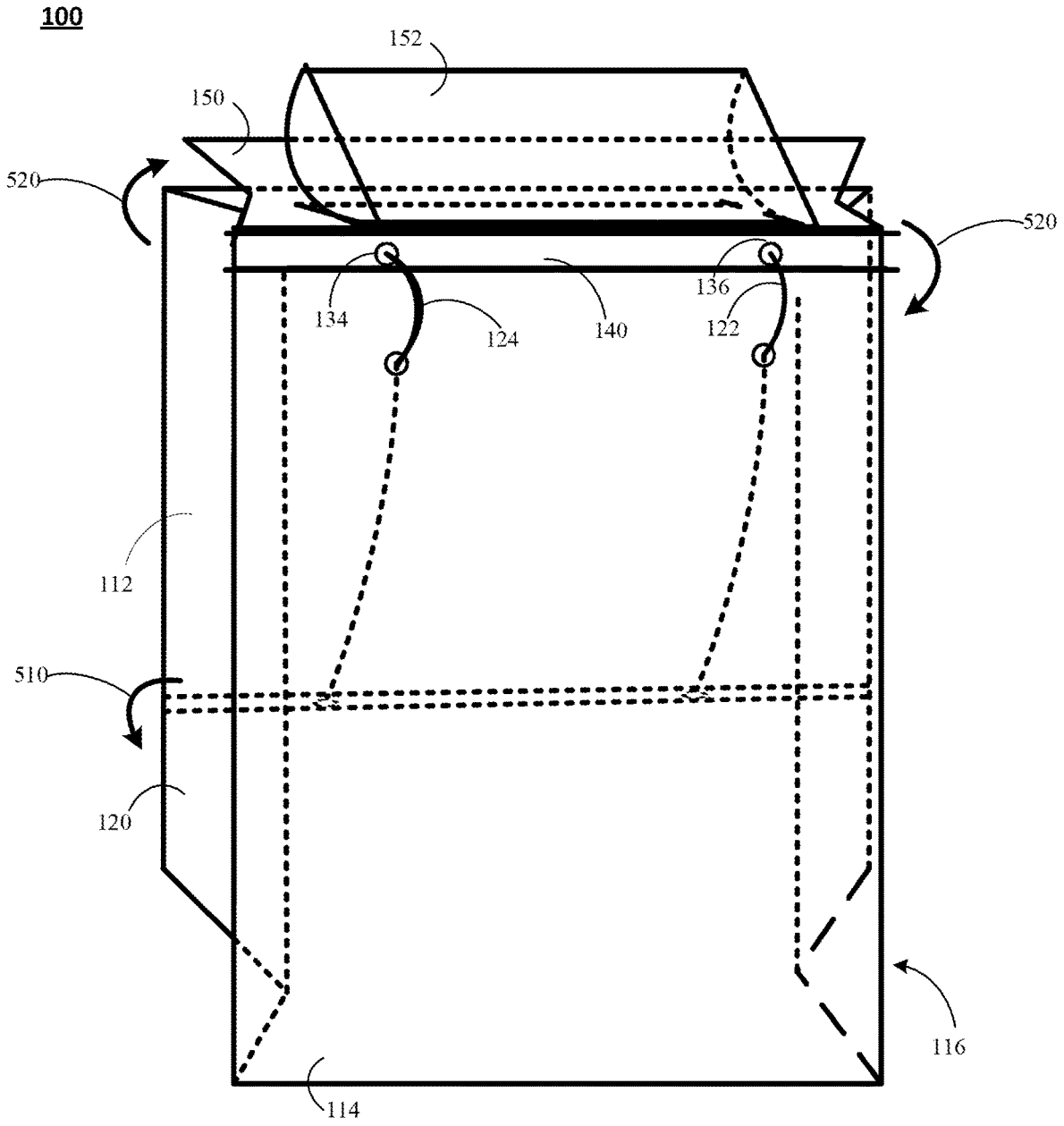
FIG. 6 a rearward perspective view of an example of the disposable container of FIG. 1 with an open rotatable access panel and an open lid.

FIG. 6 is a rearward perspective view of an example of a disposable container 100 with an open rotatable access panel 152 and an open lid 150. The disposable container 100 shown in FIG. 6 is the same as the disposable container 100 shown in FIGS. 1-5. However, the disposable container 100 shown in FIG. 5 is shown with rearward perspective view of the disposable container 100 that reveals features of the disposable container such as the rearward sidewall portion 114, opening 138, and opening 139 when the lid 150 is open. The arrows 510, 520, 530 represent the same type of rotations described with reference to FIG. 5 as a result of the same respective forces on the pedal 120, the lines 122, 124, the hinged mechanism 140, and the like lid 150 as described with reference to FIG. 5.

Figure 7A:
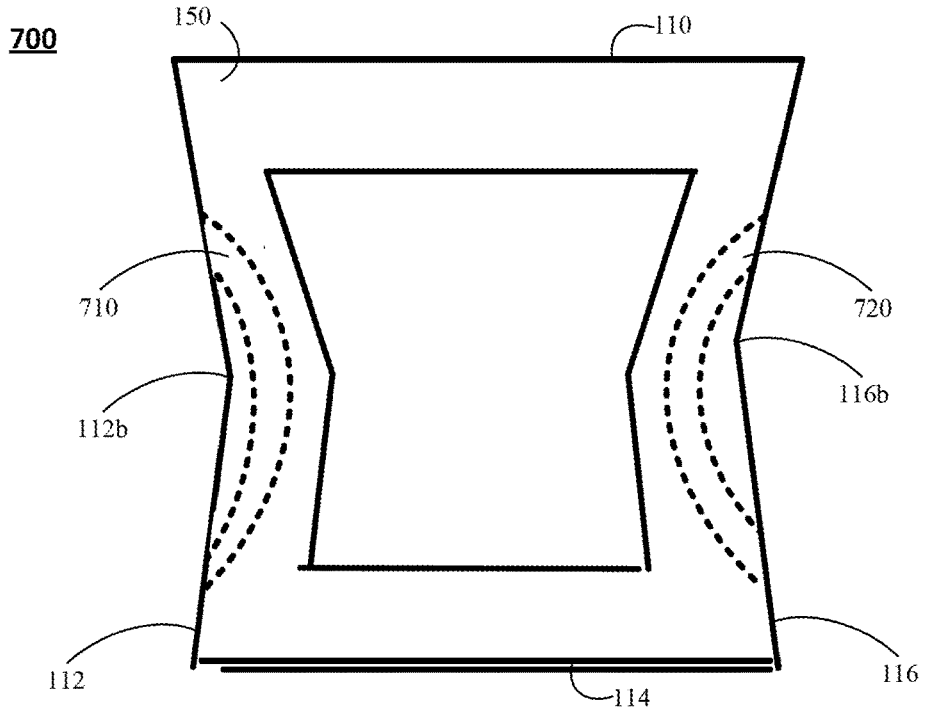
FIG. 7A is a top view of an example of a substantially expanded disposable container that includes a plurality of flexible members for automatic expansion.

FIG. 7A is a top view of an example of a substantially expanded disposable container 700 that includes a plurality of flexible members for automatic expansion. The disposable container 700 may include the same features as described with reference to the disposable container 100. In addition, the disposable container 700 includes a plurality of flexible members 710, 720 that enable automatic expansion of the disposable container 700. However, not all features of the disposable container 100 are shown in FIG. 7A, as FIG. 7A is provided to illustrate the functionality of the flexible members that provide automatic expansion of the disposable container 700.

As shown in FIG. 7A, the disposable container 700 includes a first flexible member 710 and a second flexible member 720. The first flexible member 710 includes a first end that is coupled to a first portion of the first foldable sidewall portion 112 on a first side of a vertical crease 112*b* and extends to a second portion of the first foldable sidewall portion 112 that is on a second side of the vertical crease 112*b*, where the first flexible member 710 is also coupled to the second portion of the first foldable sidewall portion 112. The first flexible member 710 may be coupled to the first foldable sidewall portion in a variety of different ways include, for example, use of an adhesive, one or more screws, one or more bolts, staples, or the like. The first flexible member 710 may be composed of one or more different types of material including plastic, aluminum, steel, or the like.

The second flexible member 720 includes a first end that is coupled to a first portion of the first foldable sidewall portion 116 on a first side of a vertical crease 116*b* and extends to a second portion of the second foldable sidewall portion 116 that is on a second side of the vertical crease 116*b*, where the second flexible member 720 is also coupled to the second portion of the second foldable sidewall portion 116. The second flexible member 720 may be coupled to the second foldable sidewall portion in a variety of different ways include, for example, use of an adhesive, one or more screws, one or more bolts, staples, or the like. The second flexible member 720 may be composed of one or more different types of material including plastic, aluminum, steel, or the like.

Figure 7B:
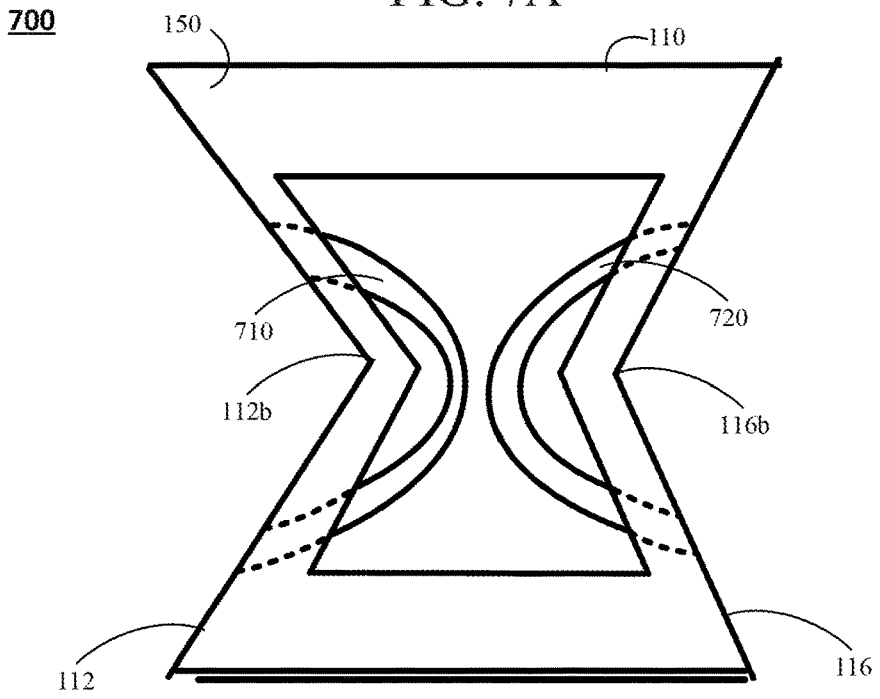
FIG. 7B is a top view of an example of a moderately expanded disposable container that includes a plurality of flexible members for automatic expansion.

FIG. 7B is a top view of an example of a moderately expanded disposable container 700 that includes a plurality of flexible members 710, 720 for automatic expansion. The disposable container 700 of FIG. 7B is the same as the disposable container of FIG. 7A. However, the disposable container 700 of FIG. 7B depicts a disposable container that has had respective forces applied to one or more side wall portions to begin to collapse the disposable container.

In response to respective forces applied to the frontward facing sidewall portion 110, the rearward facing sidewall portion 114, the first foldable sidewall portion 112, and the second foldable sidewall portion 116, the disposable container 700 can begin to collapse along predetermined crease lines such as crease lines 112*b*, 116*b*. As the disposable container begins to collapse, the respective flexible members begin to bend as shown in FIG. 7B. The bending of the flexible members 710, 720 stores energy in the respective flexible members 710, 720 that can be released as kinetic energy upon in response to the withdrawal of (e.g., release of) the respective forces that were applied to the frontward facing sidewall portion 110, the rearward facing sidewall portion 114, the first foldable sidewall portion 112, and the second foldable sidewall portion 114 to begin collapsing the disposable container 700. The released kinetic energy is used to expand the respective sidewall portions 110, 112, 114, 116 to the substantially expanded positions described with reference to FIG. 7A. For example, the release of the stored energy in the flexible member as kinetic energy causes the first end of the flexible member 710 to separate away from the second end of the flexible member 710. This separation of the first end of the flexible member 710 from of the second end of the flexible member 720 pulls open the first foldable sidewall portion 112. The second flexible member 720 can expand the second foldable sidewall portion 116 in the same manner as described with reference to the first flexible member 710 and the first foldable sidewall portion 112.

Figure 7C:
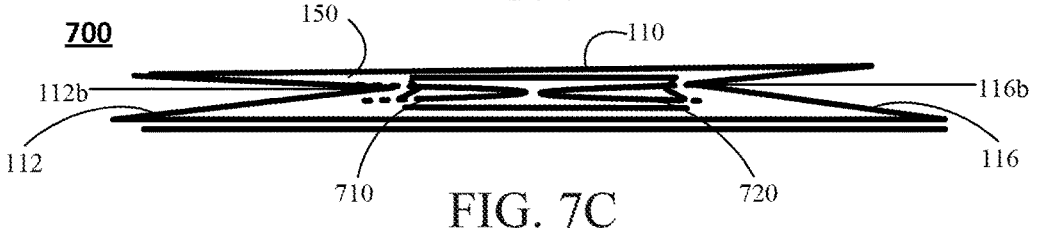
FIG. 7C is a top view of an example of a disposable container that is not expanded and includes a plurality of flexible members.

FIG. 7C is a top view of an example of a disposable container 100 that is not expanded and includes a plurality of flexible members. The disposable container 700 of FIG. 7C is the same as the disposable container of FIGS. 7A and 7B. However, the disposable container 700 of FIG. 7C depicts a disposable container that has had respective forces applied to one or more side wall portions that have substantially collapsed the disposable container 700.

In response to continued application of one or more forces, the disposable container 700 can continue to be collapsed until the disposable container 700 is substantially collapsed as shown in FIG. 7C. A disposable container 700 may become substantially collapsed when, for example, at least a portion of the a foldable sidewall portion is folded onto itself. With reference to FIG. 7C, for example, at least a portion of the first foldable sidewall portion 112 has been folded on top of itself across the predefined crease 112*b*. Similarly, with continued reference to FIG. 7C, at least a portion of the second foldable sidewall portion 116 has been folded on top of itself across the predefined crease 114*b*.

Responsive to the continued application of the one or more forces that substantially collapsed disposable container 700, each of the plurality of flexible members 710, 720 may continue to bend and accumulate stored energy. In some implementations, the flexible members 710, 720 may continue to bend and accumulate stored energy until a first end of a respective flexible member is separated from the second end of the flexible member only by the portion of the disposable container 700 that is folded between the two respective ends of the flexible member as shown in FIG. 7C. In some implementations, the portion of the disposable container 700 folded between the two respective ends of the flexible member may include the space occupied by one or more coupling units used to couple the flexible member to the interior sidewalls of the foldable sidewall portion that the flexible member is coupled to. In other implementations, however, the flexible member may be more rigid or the disposable container 700 may be less foldable. In such instances, the flexible member 710, 720 may continue to bend and accumulate energy until a first end of a respective flexible member is separated from the second end of the flexible member by a predetermined distance that is greater than the distance of the portion of the disposable container 700 that is folded between the two respective ends of the flexible members.

The collapsible nature of the disposable container 700 may be used to store the disposable container. For example, a person may store multiple disposable containers in a closet, pantry, suitcase, camping bag, vehicle, or the like in a substantially collapsed form. In some implementations, a secure wrap such as a rope, ribbon, tape, or the like may bound be wrapped around a substantially collapsed disposable container 700 in order to maintain the disposable container 700 in its substantially collapsed state until the secure wrap is severed. In response to the severing of the secure wrap, the stored energy by flexible members may be released as kinetic energy that forces the disposable container 700 to automatically expand. Other examples may include a manufacturer or sales person that bounds the substantially collapsed disposable container 700 with a secure wrap so that the disposable container 700 can be put on shipped or put on display for sale in a substantially collapsed state, thereby taking less of the space inside a shipping vehicle, a sales shelf in a store, or the like Withdrawal (or release) of the one or more forces that caused the disposable container 700 to remain collapsed triggers automatic expansion of the disposable container 700. In response to the withdrawal (or release) of the one or more forces that caused the disposable container 700 to collapse, the energy stored by the bent flexible members 710, 720 will be released and cause the disposable container 700 to expand. Expansion of the disposable container 700 is caused by each respective end of each flexible member pulling away from each other. For example, upon withdrawal of the one or more forces that caused the disposable container 700 to remain collapsed, the first end of the flexible member 710 may pull away from the second end of the flexible member 710 and cause the first foldable sidewall portion 712 to expand by unfolding along the predetermined crease 712*b*. Similarly, upon withdrawal of the one or more forces that caused the disposable container 700 to remain collapsed, the second end of the flexible member 720 may pull away from the second end of the flexible member 720 and cause the second foldable sidewall portion 716 to expand by unfolding along the predetermined crease 716*b*. In some implementations, the second send of each respective flexible member pulls away from the first end of the respective flexible member with a substantially equal and opposite force that the first end of the respective flexible member pulled away from the second end of the respective flexible member.

Expansion of the disposable container 700 from a substantially collapsed state to a substantially expanded state can be depicted by following the states of the disposable container depicted in FIGS. 7C then FIG. 7B, and finally FIG. 7A. That is, the release of the stored energy by the respective flexible members of the substantially collapsed disposable container 700 will cause the disposable container 700 to expand from a substantially collapsed state (FIG. 7C) to a moderately collapsed state (FIG. 7B) to a substantially expanded state (FIG. 7A).

The flexible members 710, 720 of the disposable container 700 are only depicted as being a part of the disposable container 700 and not explicitly depicted herein as being a part of the disposable containers 100 or 800. However, the present disclosure need not be so limited. Instead, the flexible members 710, 720 may be incorporated into either the disposable container 100, disposable container 800, or both, in order to add the automatic expansion functionality provided by the flexible members 710, 720 to the disposable container 700.

Figure 8:
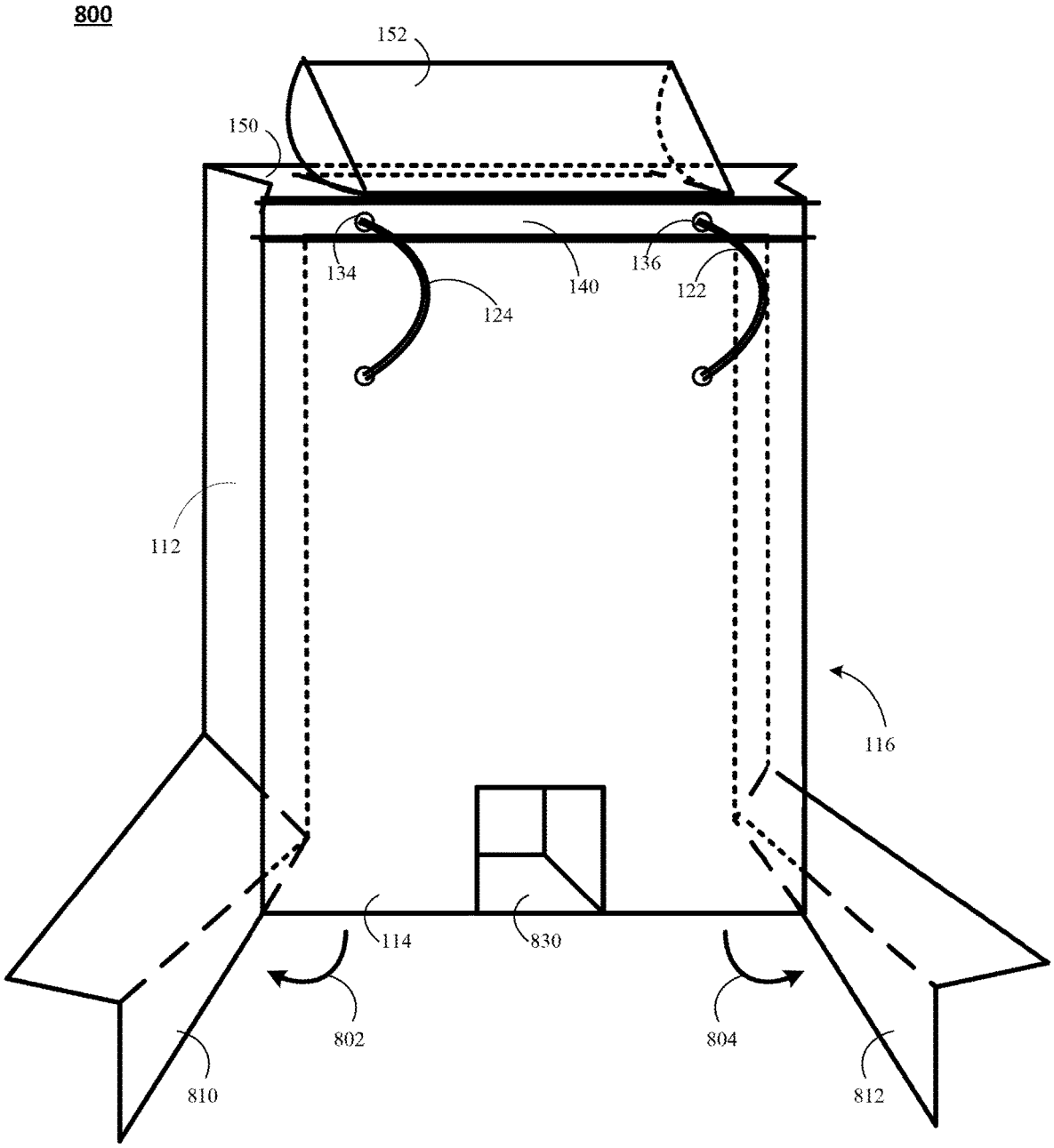
FIG. 8 is a rearward perspective view of an example of a disposable container that includes a plurality of collapsible legs and a rear access panel.

FIG. 8 is a rearward perspective view of an example of a disposable container 800 that includes a plurality of collapsible legs 810, 812 and a rear access panel 835. The disposable container 800 may the same disposable container as the disposable container 100 or 700 but with the additional inclusion of the depicted collapsible legs 810, 812 and rear access panel 835.

The collapsible legs 810, 812 may be configured to be stored underneath the disposable container 800. When stored underneath disposable container 800, the collapsible legs 810, 812 may be configured to removably latch to the bottom of the disposable container 800. The disposable container 800 may be configured to have a sufficient storage area underneath the disposable container 800 to store the collapsible legs 810, 812 and still enable the disposable container to rest flat on a surface. For example, bottom of the forward facing sidewall portion 110, the first foldable sidewall portion 112, the rearward facing sidewall portion 114, and the second foldable sidewall portion 116 may be configured to contact surface on which the disposable container 700 is resting on while creating a pocket of storage space between the surface on which the disposable container 700 is resting and the bottom surface of the interior of the disposable container. The stored collapsible legs 810, 812 may reside within this storage space while collapsed. In some implementations, the disposable container 800 may include a cover for the collapsed legs 810, 812.

The collapsible legs 810, 812 may be expanded as shown in FIG. 8. In some implementations, for example, each collapsible leg of the collapsible legs 810, 812 may be configured to rotate out and away from the bottom of the disposable container 700 to a range of approximately 90 degrees to 145 degrees from the bottom of the disposable container 800, as shown in FIG. 8. In particular, the collapsible leg 810 may rotate 90 degrees to 145 degrees away from the bottom of the disposable container 800 and towards the first foldable sidewall 112 and the collapsible leg 812 may be configured to rotate away from the bottom of the disposable container 800 and towards the second foldable sidewall 116.

The collapsible legs 810, 812 are configured to lift the bottom surface of the disposable container 800 off a surface on which the collapsible legs 810, 812 is standing. This creates a pathway for airflow to pass between the bottom surface of the disposable container 800 and the surface on which the disposable container 800 is standing. This space between the bottom surface of the container and the surface on which the disposable container 800 is standing helps to reduce the amount of humidity that can build up inside the disposable container 800.

The disposable container 800 may also include a rear access panel 835. The rear access panel 835 may enable additional functionality for the disposable container 800 other than storing items, storing trash, or the like. For example, the rear access panel 835 can enable the disposable container 800 to be used as a water container, a juice container, a wine container, or the like. For example, a bag of water, a bag of juice, a bag of wine, or the like can be placed inside the disposable container 800 and the dispenser for the bag of water, bag of juice, bag of wine, or the like can be put through the rear access panel 835. In such configurations, the disposable container 800 may be used as a water dispenser, juice dispenser, wine dispenser, or the like. In some implementations, the rear access panel 835 may be a removable or rotatable cover that can be used to cover the rear access panel 835 when not in use.

While this specification contains many specific implementation details, these should not be construed as limitations on the scope of what may be claimed, but rather as descriptions of features that may be specific to particular embodiments. Certain features that are described in this specification in the context of separate embodiments can also be implemented in combination in a single embodiment. Conversely, various features that are described in the context of a single embodiment can also be implemented in multiple embodiments separately or in any suitable subcombination. Moreover, although features may be described above as acting in certain combinations and even initially claimed as such, one or more features from a claimed combination can, in some cases, be excised from the combination, and the claimed combination may be directed to a subcombination or variation of a subcombination. Thus, though particular embodiments of the subject matter have been described, these, and other embodiments, may also fall within the scope of the following claims.

The invention claimed is:

1. A disposable container comprising:

a lid;

a frontward facing sidewall portion;

a rearward facing sidewall portion that is opposite the frontward facing sidewall portion;

a first foldable sidewall portion comprising a first crease;

a second foldable sidewall portion that is opposite the first foldable sidewall portion, the second foldable sidewall portion comprising a second crease;

a pedal, wherein the pedal is rotatably coupled to the frontward facing sidewall portion;

a hinge mechanism, wherein the hinge mechanism is rotatably coupled to the lid and the rearward facing sidewall portion;

two or more lines, each line being coupled to and between the pedal and the hinge mechanism, wherein each of the lines extends from the pedal and passes through a respective opening in the frontward facing sidewall portion and a respective opening in the rearward sidewall portion before each of the lines terminates at the hinge mechanism that is rotatably coupled to both the lid and the rearward sidewall portion; and two or more flexible members that are configured to initiate expansion of the disposable container from a collapsed state to an expanded state, wherein a first flexible member of the two or more flexible members is disposed on the first foldable sidewall portion so that a first end of the first flexible member couples to a first inner portion of the first foldable sidewall portion on a first side of the first crease of the first foldable sidewall portion and a second end of the first flexible member couples to a second inner portion of the first foldable sidewall portion on a second side of the first crease of the first foldable sidewall portion, wherein the first flexible member is configured to cause the first foldable sidewall portion to flex along the first crease in response to the application of a first force or the relief of a second force, and wherein a second flexible member of the two or more flexible members is disposed on the second foldable sidewall portion so that a first end of the second flexible member couples to a first inner portion of the second foldable sidewall portion on a first side of the second crease of the second foldable sidewall portion and a second end of the second flexible member couples to a second inner portion of the second foldable sidewall portion on a second side of the second crease in the second foldable sidewall portion, wherein the second flexible member is configured to cause the second foldable sidewall portion to flex along the first crease in response to the application of a third force or the relief of a fourth force.

2. The disposable container of claim 1, wherein at least a portion of the pedal is configured to (i) rotate downwards in response to the application of a first force to the pedal and (ii) apply a second force to at least one of the two or more lines in response to the first force that is applied to the pedal.

3. The disposable container of claim 2, wherein at least a portion of the hinge mechanism is configured to rotate downwards and apply a third force to the lid in response to the second force that is applied to at least one of the two or more lines by the pedal responsive to the first applied force.

4. The disposable container of claim 3, wherein the lid is configured to open in response to the third force that is applied to the lid responsive to the downwards rotation of at least a portion of the hinge mechanism.

5. The disposable container of claim 1, wherein applying a first force to the pedal pulls (i) a first line of the two or more lines through a first opening and a third opening and exerts a second force on the hinge mechanism and (ii) a second line of the two or more lines through a second opening and a fourth opening and exerts a third force on the hinge mechanism.

6. The disposable container of claim 5, wherein the hinge mechanism exerts one or more fourth forces to the lid in response to the second force and the third force.

7. The disposable container of claim 6, wherein the lid is configured to separate from at least a portion of the frontward facing sidewall portion, the first foldable sidewall portion, and the second foldable sidewall portion in response to the one or more fourth forces.

8. The disposable container of claim 5, wherein terminating application of the first force from the pedal retracts (i) at least a portion of the first line of the two or more lines through the third opening and the first opening and (ii) at least a portion of the second line of the two or more lines through the fourth opening and the second opening.

9. The disposable container of claim 8, wherein the lid is configured to move back towards one or more of the frontward facing sidewall portion, the first foldable sidewall portion, or the second foldable sidewall portion in response to termination of the application of the first force.

10. The disposable container of claim 1, wherein the lid comprises a rotating panel that can be configured into different states that comprise a closed state and an open state, wherein the closed state denies access to an interior of the disposable container through the lid and the open state provides access to the interior of the disposable container through the lid.

11. The disposable container of claim 1, wherein at least the frontward facing sidewall portion, the rearward facing sidewall portion, the first foldable sidewall portion, the second foldable sidewall portion, and the lid are made of cardboard.

* * * * *